US007020911B2

(12) United States Patent
Oldham

(10) Patent No.: US 7,020,911 B2
(45) Date of Patent: Apr. 4, 2006

(54) CONVERTIBLE FURNITURE

(76) Inventor: Jacky Todd Oldham, 50 Murray St., #1601, New York, NY (US) 10007

( * ) Notice: Subject to any disclaimer, the term of this patent is extended or adjusted under 35 U.S.C. 154(b) by 0 days.

(21) Appl. No.: 10/815,225

(22) Filed: Mar. 31, 2004

(65) Prior Publication Data

US 2005/0217022 A1 Oct. 6, 2005

(51) Int. Cl.
*A47C 4/00* (2006.01)

(52) U.S. Cl. ..... 5/12.2; 5/52; 5/285; 297/411.24; 297/411.27; 297/440.1

(58) Field of Classification Search ..... 5/52, 5/53.1, 121, 12.2, 285; 297/411.23–411.27, 297/440.1, 440.14, 440.15, 451.8
See application file for complete search history.

(56) References Cited

U.S. PATENT DOCUMENTS 2,774,977 A * 12/1956 Mintz ..... 5/12.1
2,815,067 A * 12/1957 Richardson ..... 297/440.15
3,036,864 A * 5/1962 Arai ..... 297/463.1
4,022,502 A * 5/1977 Smith et al. ..... 297/411.23
4,305,616 A * 12/1981 Martinez ..... 297/440.15
5,615,926 A * 4/1997 Kanai et al. ..... 297/411.27

* cited by examiner

*Primary Examiner*—Michael Trettel
(74) *Attorney, Agent, or Firm*—Harness, Dickey & Pierce, P.L.C.

(57) ABSTRACT

The present invention provides a convertible furniture piece generally including a base, a first quick-release locking mechanism, a first cushion member and a first support bracket. The first quick-release locking mechanism is attached to the base. The first cushion member has a first surface and a second surface generally perpendicular to each other. The first surface is supported on the base. The first support bracket is removably attached to the base by the first quick-release locking mechanism. The first support bracket engages the second surface of the first cushion member to solely provide lateral support thereto.

25 Claims, 5 Drawing Sheets

FIG 1
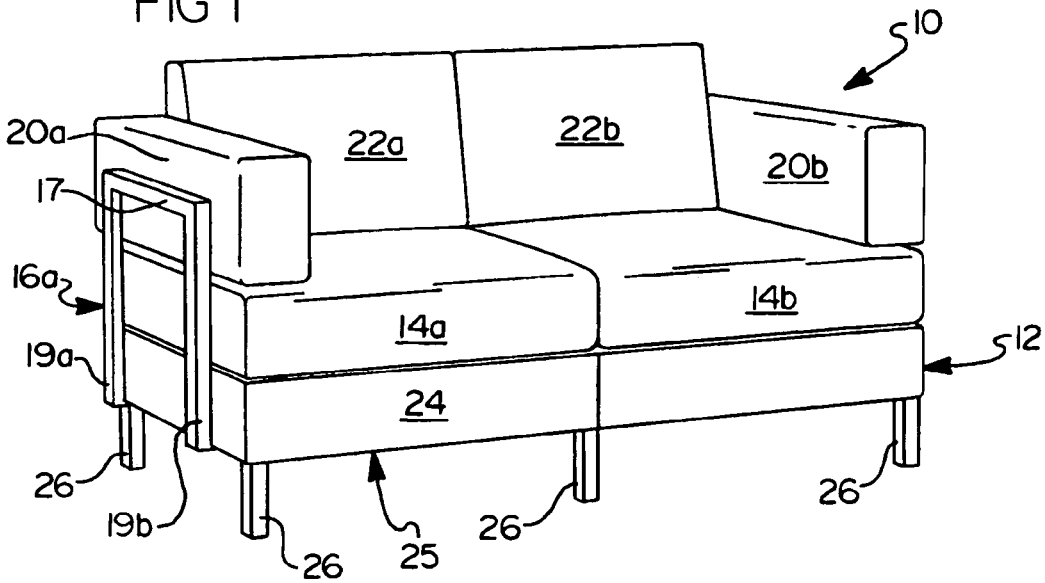
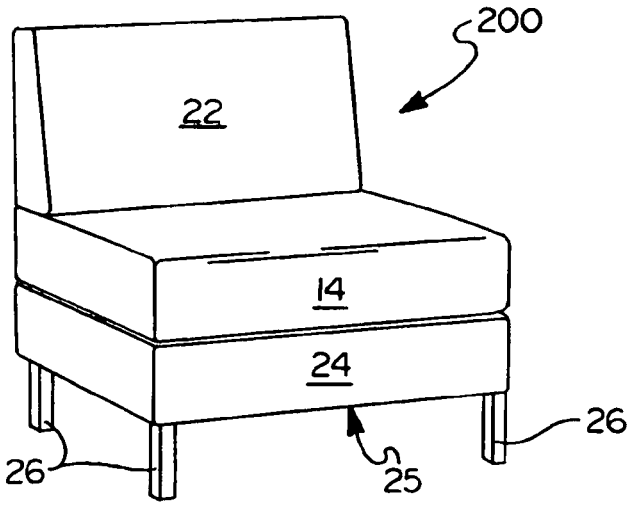
FIG 6

FIG 4D
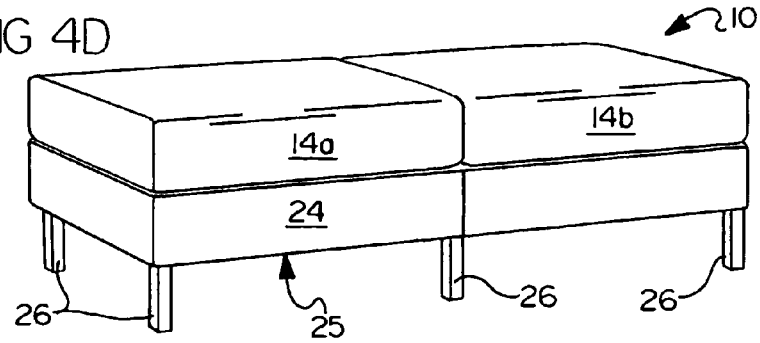
FIG 4E
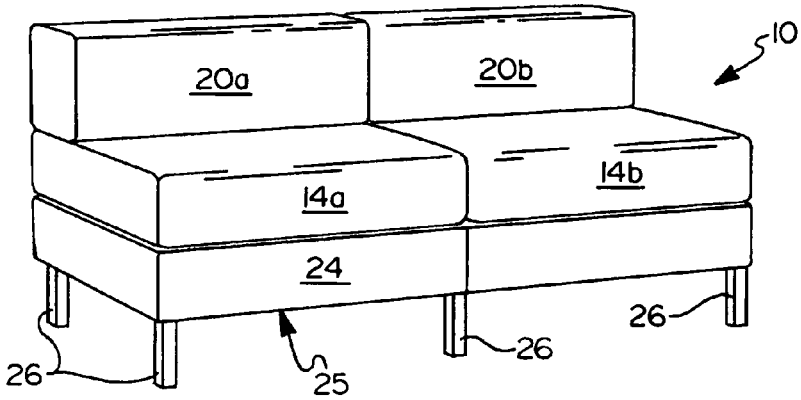
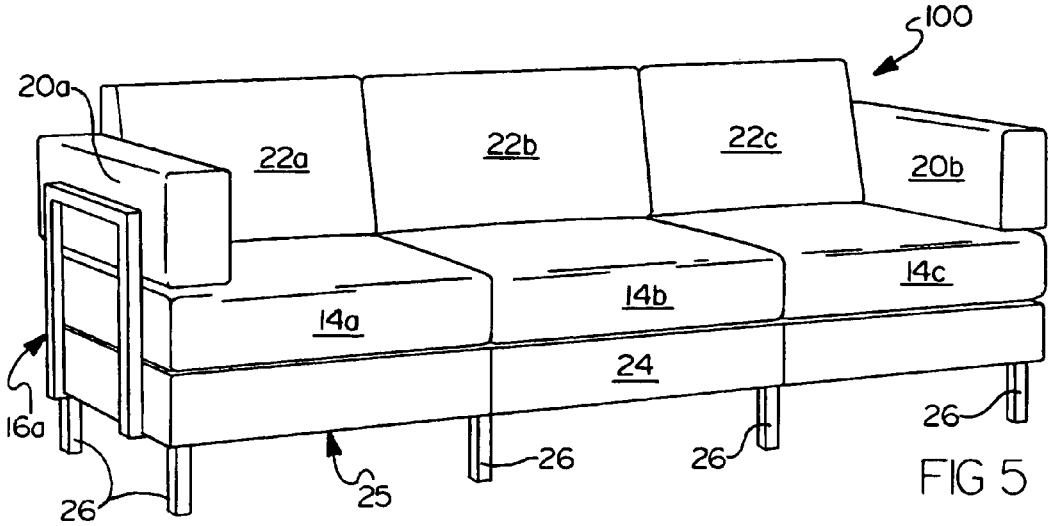
FIG 5

CONVERTIBLE FURNITURE

FIELD OF THE INVENTION

The present invention relates to convertible furniture and, more particularly, to convertible furniture having a plurality of configurations.

BACKGROUND OF THE INVENTION

Interior decorating and furnishing markets are ever expanding. However, recently there is a growing focus on furniture capable of adapting to various decorating and/or design choices. Preferably, these furniture pieces would be capable of being configured in a wide variety of arrangement, thereby providing added utility in its ability to be used in multiple environments. For example, when new space is acquired, such as a new home, apartment, or office, or when old space is simply redecorated, consumers are often required to purchase new furniture to fit within the new space or decorating scheme. Obviously, this can become expensive to the consumer. Alternatively, if one chooses to use existing furniture pieces, those pieces may not fully compliment the intended design scheme.

Accordingly, there exists a need in the relevant art to provide a furniture pieces that are capable of being quickly and easily configured into multiple design configurations without requiring the purchasing of entire additional furniture pieces. Furthermore, there exists a need in the relevant art to provide a convertible furniture piece that provides the additional utility sought by consumers to enhance design creativity. Still further, there exists a need in the relevant art to provide a convertible furniture piece that is capable of overcoming the disadvantages of the prior art.

SUMMARY OF THE INVENTION

The present invention provides a convertible furniture piece having an advantageous construction that finds utility in a wide variety of applications. The convertible furniture piece generally including a base, a first locking mechanism, a first cushion member, and a first support bracket. The first locking mechanism is attached to the base. The first cushion member has a first surface and a second surface generally perpendicular to each other. The first surface is supported on the base. The first support bracket is removably attached to the base by the first locking mechanism. The first support bracket engages the second surface of the first cushion member to provide lateral support thereto.

Another aspect of the present invention provides a method of assembling a convertible furniture piece. The method initially includes a first support bracket being positioned into engagement with a first locking mechanism. The first locking mechanism is attached to a base. The first locking mechanism is then manipulated to removably attach the first support bracket to the base. Finally, a second cushion member having a first surface and a second surface is positioned on the base such that the base engagingly supports the first surface and the first support bracket engages the second surface to provide lateral support thereto.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a perspective view of a convertible furniture piece in accordance with the present invention having an exemplary configuration;

FIG. 4D is a perspective view of the convertible furniture piece of FIG. 1 in a fourth alternative configuration;

FIG. 4E is a perspective view of the convertible furniture piece of FIG. 1 in a fifth alternative configuration;

FIG. 5 is a perspective view of a first alternative embodiment of a convertible furniture piece in accordance with the present invention having an exemplary configuration; and FIG. 6 is a perspective view of a second alternative embodiment of a convertible furniture piece in accordance with the present invention having an exemplary configuration.

DETAILED DESCRIPTION OF THE PREFERRED EMBODIMENTS

The following description of the preferred embodiments is merely exemplary in nature and is in no way intended to limit the scope of the invention, its application, or its uses. For example, the principles of the present invention may find utility in a wide variety of furniture pieces, such as sofas, loveseats, chairs, sectionals, and the like. Accordingly, the present application should not be regarded as being limited to the exact configuration illustrated or described herein.

Figure 2:
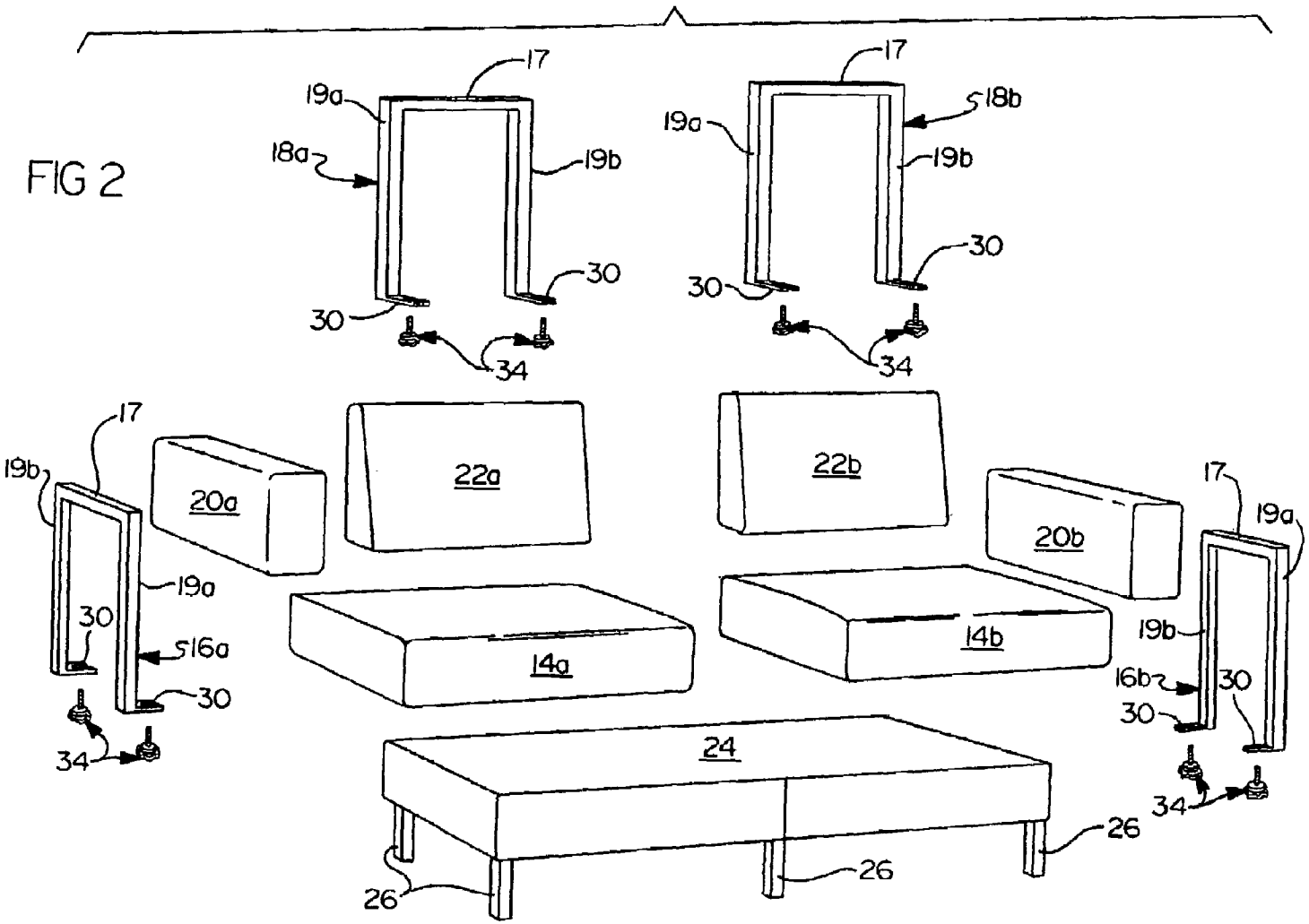
FIG. 2 is an exploded perspective view of the convertible furniture piece of FIG. 1.

With reference to FIGS. 1 and 2, a convertible furniture piece 10 is illustrated in accordance with the present invention. The convertible furniture piece 10 generally includes a base 12, a plurality of seat cushions 14*a*, 14*b*, a pair of side support brackets 16*a*, 16*b*, a pair of back support brackets 18*a*, 18*b*, a pair of first upright cushions 20*a*, 20*b*, a pair of second upright cushions 22*a*, 22*b*, and a plurality of quick-release locking mechanisms 34 (shown in FIGS. 2 and 3). The base 12 includes a rectangular platform portion 24 supported on a plurality of feet 26. The plurality of feet 26 are preferably attached to an underside 25 of the platform portion 24 at its corners and at its mid-region. In the embodiment illustrated, the plurality of feet 26 includes six feet.

The seat cushions 14 are supported on the platform portion 24 of the base 12. In an exemplary embodiment, the seat cushions 14 are furnishing cushions including rectangular shaped foam members encased in a material, such as a fabric.

As best seen in FIG. 2, the support brackets 16,18 each include a header 17 fixedly coupled between two legs 19*a*, 19*b*. In the embodiment illustrated, the support brackets 16, 18 are constructed of tubular metal having a generally square cross-section. It should be appreciated that the side support brackets 16 are preferably constructed identical to the back support brackets 18. This promotes manufacturing and assembly efficiency, as well as interchangeability of the brackets 16, 18. Furthermore, the support brackets 16, 18 each include a flange portion 30 disposed on the legs 19 at an end opposite the header 17 (see FIGS. 3A and 3B). The flange portions 30 extend generally perpendicular from the legs 19 and include a slot 32.

The first upright cushion 20 and the second upright cushion 22 generally include rectangular foam cores encased in a material, such as fabric. In the present embodiment, the first upright cushions 20 are of generally smaller dimensions than the second upright cushions 22. The first upright cushions 20 have a bottom surface engaging the seat cushions 14 and a side surface engaging the side support brackets 16. Likewise, the second upright cushions 22 have a bottom surface engaging the seat cushions 14 and a side surface engaging the back support brackets 18. The side 16 and back 18 support brackets are adapted to solely provide lateral support to the first upright cushions 20 and the second upright cushions 22.

Figure 3A:
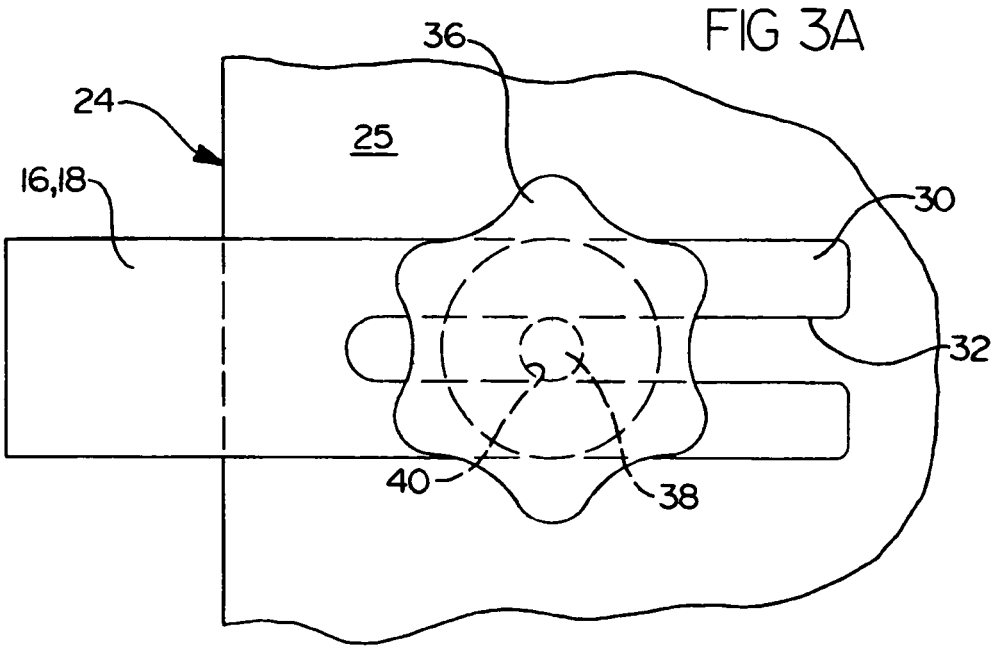
FIG. 3A is a bottom detail view of the interface between a quick-release locking mechanism and a support bracket of the convertible furniture piece of FIG. 1.
Figure 3B:
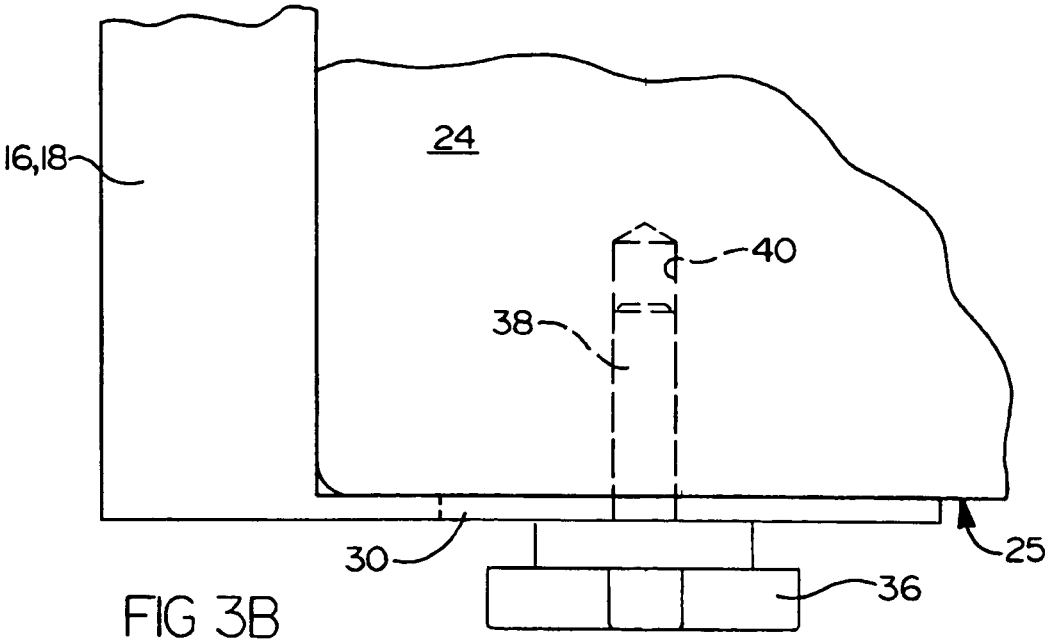
FIG. 3B is a side detail view of the interface between the quick-release locking mechanism and the support bracket of the convertible furniture piece of FIG. 1.

With reference to FIGS. 3A and 3B, the quick-release locking mechanisms 34 generally include a handle portion 36 and a threaded shaft portion 38. The threaded shaft portions 38 threadably engage one of a plurality of bores 40 formed in the underside 25 of the platform portion 24 of the base 12. The slots 32 in the flange portions 30 of the support brackets 16, 18 receive the shaft portions 38. The handle portions 36 compressively engage the flange portions 30, thereby securing the support brackets 16,18 to the base 12.

To remove the support brackets 16, 18, the handle portions 36 are turned to partially retract the shafts 38 from the bores 40. This releases the compressive force previously applied to the flanges 30 and disengages the support brackets 16, 18 from the base. Thereafter, the flange portions 30 may be slid out from under the handle portions 36, thereby removing the support brackets 16, 18 from the base 12. This arrangement provides for a quick-release type application. No tools are required to remove the support brackets 16, 18 from the base 12. Furthermore, the handle portions 36 can be easily manipulated to attach or remove the support brackets 16, 18 without needing to capsize the base 12.

It should be understood that the present embodiment may be varied such that the underside 25 of the base 12 includes a plurality of threaded shafts and the quick-release locking mechanisms 34 include a handle portion 26 having a threaded nut. This alternative construction operates in generally the same manner and provides the same benefits as the construction described above.

Figure 4A:
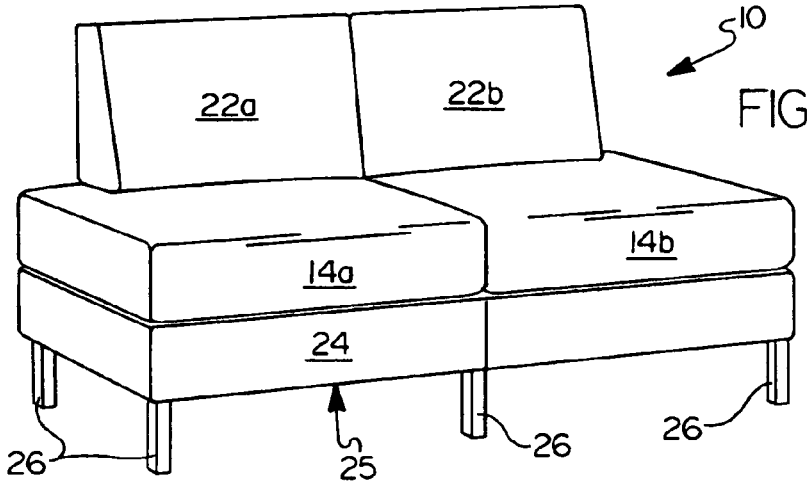
FIG. 4A is a perspective view of the convertible furniture piece of FIG. 1 in a first alternative configuration.
Figure 4B:
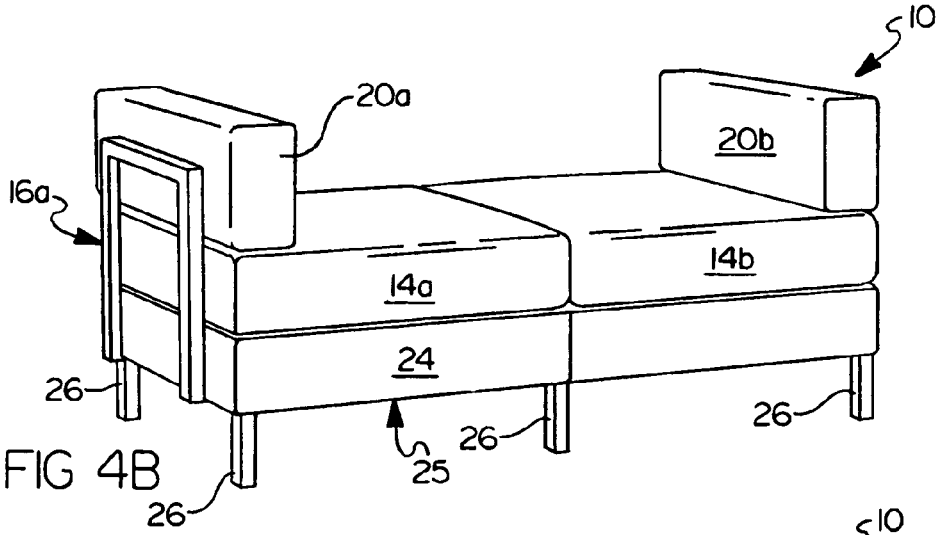
FIG. 4B is a perspective view of the convertible furniture piece of FIG. 1 in a second alternative configuration.
Figure 4C:
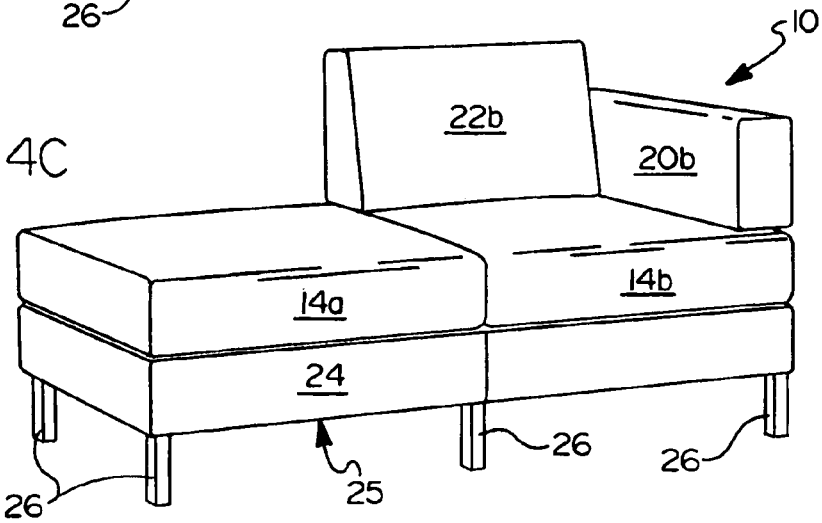
FIG. 4C is a perspective view of the convertible furniture piece of FIG. 1 in a third alternative configuration.

Referring now to FIGS. 4A–4E, the convertible furniture piece 10 of the present invention is convertible between a plurality of configurations. FIG. 4A illustrates a convertible furniture piece 10, wherein the side support brackets 16 and the first upright cushions 20 have been removed from the base 12. Therefore, a loveseat-type furniture piece having only back rests remains. FIG. 4B illustrates a convertible furniture piece 10, wherein the back support brackets 18 and the second upright cushions 22 have been removed from the base 12. Therefore, a loveseat-type furniture piece having only arm rests remains. FIG. 4C illustrates a convertible furniture piece 10, wherein one of the side support brackets, specifically 16*a*, and one of the back support brackets, specifically 18*a*, have been removed from the base 12. In addition, the corresponding first upright cushion 20*a* and the second upright cushion 22*a* have been removed from the base 12. Therefore, a loveseat-type furniture piece resembling a chaise lounge remains. FIG. 4D illustrates a convertible furniture piece 10, wherein the side support brackets 16 and the back support brackets 18 have been removed from the base 12. In addition, the first upright cushions 20 and second upright cushions 22 have been removed from the base 12. Therefore, a loveseat-type furniture piece resembling a two-cushion seating platform remains. FIG. 4E illustrates a convertible furniture piece 10, wherein the side support brackets 16 have been removed from the base 12. In addition, the second upright cushions 22 have been removed from the base 12 and replaced by the first upright cushions 20. This provides a loveseat-type furniture piece 10 similar to that illustrated in FIG. 4A, wherein the backrest extends across the entire width of the loveseat. Furthermore, the back rest is lower than that illustrated in FIG. 4A.

With reference to FIG. 5, a first alternative embodiment of a convertible furniture piece 100 is illustrated in accordance with the present invention. The convertible furniture piece 100 is generally the same as that described above, except that it includes a larger platform portion 24, three back support brackets 18*a*, 18*b*, 18*c* (not shown), three second upright cushions 22*a*, 22*b*, 22*c*, and three seat cushions 14*a*, 14*b*, 14*c*. This defines a convertible furniture piece 100 resembling a sofa. The sofa-type convertible furniture piece 100 is convertible into a plurality of configurations, similar to those described above.

With reference to FIG. 6, a second alternative embodiment of a convertible furniture piece 200 is illustrated in accordance with the present invention. The convertible furniture piece 100 is generally the same as those described above, except that it includes a smaller platform portion 24, one back support bracket 18 (not shown), one second upright cushion 22, and one seat cushion 14. In addition, the second alternative embodiment lacks side support brackets 16 and first upright cushions 20. This defines a convertible furniture piece 200 resembling an armless chair. It should be appreciated, however, that an apparatus having first upright cushions 20 is intended to be within the scope of the present invention. Such an apparatus would resemble an arm chair. The chair-type convertible furniture piece 200 may be converted into a backless chair by simply removing the back support bracket 18 and second upright cushion 22 from the base 12.

It should be appreciated that while a limited number of configurations have been described regarding the loveseat-type, sofa-type and chair-type convertible furniture pieces, any configuration achieved by similar manipulation of the furniture components is intended to be within the scope of the present invention. It should further be appreciated that a convertible furniture piece 10 in accordance with the present invention may also include any number of back support brackets 18, second upright cushions 22, and seat cushions 14. Lastly, it should be appreciated that the convertible furniture piece of the present invention may include a base 12 having non-rectangular geometry. Therefore, a convertible furniture piece having an L-shaped, U-shaped or any other shaped base 12 is intended to be within the scope of the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A convertible furnishing apparatus, comprising:

a base;

a first quick-release locking mechanism attached to said base;

a first auxiliary member having a first exterior surface supported on said base; and a first support bracket removably attached to said base by said first quick-release locking mechanism, said first support bracket being external of said first auxiliary member and engaging a second exterior surface of said first auxiliary member, wherein said first support bracket provides the sole means of lateral support thereto such that said auxiliary member is free from mechanical fastening means, further wherein said first and second surfaces are disposed in intersecting planes.

2. The furnishing apparatus of claim 1 wherein said first auxiliary member is selected from the group consisting of a back rest and an arm rest.

3. The furnishing apparatus of claim 1 wherein said first and second exterior surfaces are substantially perpendicular.

4. The apparatus of claim 1 wherein said first support bracket includes a header and at least one leg extending generally perpendicular therefrom.

5. The apparatus of claim 4 wherein said first support bracket further includes a flange portion having a slot engaging said first quick-release locking mechanism.

6. The apparatus of claim 1 wherein said first quick-release locking mechanism includes a threaded fastener engaging said base.

7. The apparatus of claim 1 wherein said base is selected from the group consisting of a sofa base, a loveseat base and a chair base.

8. The furnishing apparatus of claim 1 further comprising:

a second quick-release locking mechanism attached to said base;

a second auxiliary member having a first exterior surface supported on said base; and a second support bracket removably attached to said base by said second quick-release locking mechanism, said second support bracket being external of said second auxiliary member and engaging a second exterior surface of said second auxiliary member, wherein said second support bracket provides lateral support to said second surface such that said second auxiliary member is free from mechanical fastening means, further wherein said first and second surfaces are disposed in intersecting planes.

9. The furnishing apparatus of claim 8 wherein said first and second auxiliary members are each back rests.

10. The furnishing apparatus of claim 8 wherein said first and second auxiliary members are each arm rests.

11. The furnishing apparatus of claim 8 wherein said first auxiliary member is one of an arm rest and a back rest and said second auxiliary member is the other of an arm rest and a back rest.

12. The furnishing apparatus of claim 11 wherein said arm rest has a first dimension and said back rest has a second dimension corresponding to said first dimension that is larger than said first dimension.

13. The apparatus of claim 8 wherein said first and second auxiliary members are interchangeable.

14. The apparatus of claim 8 wherein said first and second support brackets are interchangeable.

15. A method of assembling a convertible furnishing apparatus, said method comprising:

positioning a first external support bracket into engagement with a first quick-release locking mechanism that is attached to a base;

manipulating said first quick-release locking mechanism to removably attach said first support bracket to said base; and positioning a first auxiliary member having a first exterior surface and a second exterior surface on said base such that said base engages said first exterior surface and said first support bracket engages said second exterior surface and provides the sole means of lateral support thereto such that said auxiliary member is free from mechanical fastening means, further wherein said first and second surfaces are disposed in intersecting planes.

16. The method of claim 15 further comprising the step of selecting a base from the group consisting of a sofa base and a loveseat base prior to positioning a first support bracket generally adjacent to a base.

17. The method of claim 15 further comprising the step of selecting a first auxiliary member from the group consisting of an arm rest and a back rest prior to positioning a first auxiliary member.

18. The method of claim 15 wherein said steps of removably attaching a first support bracket and a second support bracket to said base each include threading a fastener into a bore formed in said base.

19. The method of claim 15 further comprising:

positioning a second external support bracket into engagement with a second quick-release locking mechanism that is attached to said base;

manipulating said second quick-release locking mechanism to removably attach said second support bracket to said base; and positioning a second auxiliary member having a first exterior surface and a second exterior surface on said base such that said base engages said first exterior surface and said second support bracket engages said second exterior surface and provides lateral support thereto such that said second auxiliary member is free from mechanical fastening means, further wherein said first and second surfaces are disposed in intersecting planes.

20. The method of claim 19 wherein said positioning of said first and second auxiliary members is interchangeable.

21. The method of claim 19 wherein said positioning of said first and second support brackets is interchangeable.

22. The method of claim 19 wherein said step of positioning a first support bracket includes positioning said first support bracket generally adjacent to a first side of said base and said step of positioning a second support bracket includes positioning said second support bracket generally adjacent to a second side of said base, wherein said first and second sides of said base are perpendicular.

23. The method of claim 19 wherein said step of positioning a first support bracket includes positioning said first support bracket generally adjacent to a first side of said base and said step of positioning a second support bracket includes positioning said second support bracket generally adjacent to a second side of said base, wherein said first and second sides of said base are parallel.

24. The method of claim 19 further comprising the step of selecting a second auxiliary member from the group consisting of an arm rest and a back rest prior to positioning a second auxiliary member.

25. A convertible furnishing apparatus, comprising:

a base unit comprising at least four feet;

first and second quick-release locking mechanisms attached to said base;

first and second interchangeable auxiliary members each having a first exterior surface supported on said base; and first and second interchangeable external support brackets each removably attached to said base by one of said quick-release locking mechanisms, each said support bracket being external of said auxiliary members and engaging a second exterior surface of said respective auxiliary members, wherein said support brackets provide the sole means of lateral support such that each said auxiliary member is free from mechanical fastening means.

* * * * *